US007387152B2

(12) United States Patent
Manda

(10) Patent No.: US 7,387,152 B2
(45) Date of Patent: Jun. 17, 2008

(54) METALLIC-MOLDING-MATERIAL RUNNER HAVING EQUILIBRATED FLOW

(75) Inventor: Jan Marius Manda, Toronto (CA)

(73) Assignee: Husky Injection Molding Systems Ltd., Bolton, Ontario (CA)

( * ) Notice: Subject to any disclaimer, the term of this patent is extended or adjusted under 35 U.S.C. 154(b) by 0 days.

(21) Appl. No.: 11/748,562

(22) Filed: May 15, 2007

(65) Prior Publication Data

US 2007/0221352 A1 Sep. 27, 2007

Related U.S. Application Data

(62) Division of application No. 11/363,803, filed on Feb. 24, 2006.

(51) Int. Cl.
*B22D 35/04* (2006.01)
*B22D 35/06* (2006.01)

(52) U.S. Cl. ..... 164/113; 164/135

(58) Field of Classification Search ..... 164/113, 164/312, 133–135, 337
See application file for complete search history.

(56) References Cited

U.S. PATENT DOCUMENTS 5,762,855 A 6/1998 Betters et al.
5,853,041 A * 12/1998 Aoyama ..... 164/312
5,983,978 A * 11/1999 Vining et al. ..... 164/312
6,099,767 A 8/2000 Tarr et al.
6,533,021 B1 3/2003 Shibata et al.
6,767,486 B2 7/2004 Doughty et al.
6,875,383 B2 4/2005 Smith et al.
6,938,669 B2 9/2005 Suzuki et al.
2005/0255187 A1 * 11/2005 Kazmer ..... 425/563

FOREIGN PATENT DOCUMENTS

EP 1101550 A1 5/2001
WO WO 97/27988 * 8/1997
WO 2004/078383 A1 9/2004
WO 2005/110704 A1 11/2005

* cited by examiner

*Primary Examiner*—Kuang Lin

(57) ABSTRACT

Disclosed a method of a metallic-molding-material runner system for filling a metallic-molding material into a mold cavity of a mold, the metallic-molding material includes a metallic component, the method including: substantially equilibrating flow of the metallic-molding material through a collection of branches from a molding system into the mold by; (i) receiving the metallic-molding material from the molding system through an input being defined by a conduit assembly, the conduit assembly including the collection of branches each being configured to pass the metallic-molding material from the input over to outputs of the collection of branches; (ii) conveying the metallic-molding material from the input through the collection of branches of the conduit assembly over to the outputs; (iii) forming plugs in the outputs; and (iv) chronological blowing out the plugs from the outputs into the mold cavity of the mold.

1 Claim, 3 Drawing Sheets

METALLIC-MOLDING-MATERIAL RUNNER HAVING EQUILIBRATED FLOW

CROSS-REFERENCE TO RELATED PATENT APPLICATION

This patent application is a divisional patent application of prior U.S. patent application Ser. No. 11/363,803 filed Feb. 24, 2006. This divisional patent application also claims the benefit and priority date of prior U.S. patent application No. 11/363,803 filed Feb. 24, 2006.

TECHNICAL FIELD

The present invention generally relates to, but is not limited to, molding systems, and more specifically the present invention relates to metallic-molding-material runner systems and/or to molding systems having metallic-molding-material runner systems and/or to methods of metallic-molding-material runner systems, each of which equilibrated flow of a metallic-molding material from a molding system into a mold.

BACKGROUND

Molding systems, such as the Thixosystem manufactured by Husky Injection Molding Systems Limited, are used for molding parts made from a metallic-molding material, such as (but limited to) magnesium, aluminum, and/or zinc, (or alloys thereof), etc. Some molds define a complicated mold cavity that may be difficult to fill with the metallic-molding material because the metallic-molding material needs to be handled at a very hot operating temperature (such as, 1075 degrees Fahrenheit or 580 degrees Centigrade) and then it needs to be cooled down to a temperature that is significantly lower than the operating temperature.

A critical issue with filling the mold with the metallic-molding material is whether there is sufficient "pack-out" pressure applied to the metallic-molding material to pack out the mold. The pack-out problem usually leads to defects in a molded part, such as shrinkage-porosity defects and/or flow defects. For example, magnesium experiences a reduction of approximately 10% in volume when the magnesium changes from a molten state to a solid state. To overcome this difficulty, a sufficient pack-out pressure must be applied to the metallic-molding material after the mold is filled. However, molds usually have complicated geometries and it is very difficult to ensure pack out of the mold. If a first section of the mold becomes filled before a second section of the mold is filled, the first section will become packed out under a significantly lower pressure because the second section has not yet been filled. The first section will shrink significantly and will have a lower density in comparison to the second section because the second section will experience a pack out pressure that was not experienced by the first section.

The following is a summary of potential art that does not appear to provide a solution to the above-mentioned problem of packing out molds with a metallic-molding material. Resin-based molding materials are not analogous to metallic-molding materials because metallic-molding materials (i) have a low heat capacity such that heat flows quickly from the metallic-molding material over to molding-system components, while in sharp contrast, resin-based molding materials have a high heat capacity such that heat flows slowly from the resin-based molding material over to molding-system components, and (ii) metallic-molding materials are melted at significantly higher temperatures in sharp contrast to the temperatures at which resin-based molding materials are melted.

U.S. Pat. No. 5,762,855 (Inventor: Betters et al; Published: Jun. 9, 1998) discloses molding of large components for use in automotive bumpers by using a sequential fill valve gated injection molding system operative on plastic-resin-based molding material.

U.S. Pat. No. 6,875,383 (Inventor: Smith et al; Published: Apr. 5, 2005) discloses injection molding of a molten material by sequentially injecting the molten material into mold cavities at a rate to fill and pack the cavities with the molten material, and then holding the molten material in the mold cavities. The methods and devices appear to be effective to reduce the clamping force needed to clamp multiple cavity molds.

U.S. Pat. No. 6,099,767 (Inventor: Tarr et al; Published: Aug. 8, 2000) discloses an injection mold bushing having central passageway for shut-off gate pin and separate passageway for injecting molten plastic. The wear bushing is positioned at the outlet end of the mold bushing to protect it from wear from the molten plastic and to direct the plastic through a tip orifice.

U.S. Pat. No. 6,767,486 (Inventor: Doughty et al; Published: Jul. 27, 2004) discloses an injection molding system that includes a controller to control rate of material flow through first runner independently of second runner.

The following references appear to be applicable to systems and components for molding metallic-molding materials, but they appear to not resolve the problem of pack out of metallic molding material held in a mold.

PCT Patent No. WO 2004/078383 A1 (Inventor: Manda; Published: Sep. 16, 2004; Assignee: Husky Injection Molding Systems Limited, Canada) discloses a sprue apparatus for injection molding or die-casting machine. The sprue apparatus has a nozzle connection interface, a melt duct, a mold-connection interface, and thermal regulators for regulating thermal zones that segment length of the sprue apparatus.

European Patent No. 1,101,550 A1 (Inventor: Massano et al; Published: May 23, 2001; Assignee: Plasthing Services S.r.l., Italy) discloses a mold for injection molding of e.g. magnesium, magnesium alloy. The mold has electrical resistors arranged for heating feed socket, distribution plate, injectors and spacer elements.

PCT Patent No. WO 2005/110704 A1 (Inventor: Manda et al; Published:; Assignee: Husky Injection Molding Systems Limited, Canada) discloses a molding-machine-melt-conduit coupler useful in a runner system and in an injection-molding machine. The coupler includes coupling structure having surface coupling with two melt conduits and cooling structure to provide coolant to coupling structure.

U.S. Pat. No. 6,938,669 (Inventor: Suzuki et al; Published: Sep. 6, 2005; Assignee: Denso Corporation, Japan) discloses injection molding of metal products that involves heating tip of hot runner, spraying lubricant onto molding surface and metering material, simultaneously between mold clamping and pressurizing processes.

U.S. Pat. No. 6,533,021 (Inventor: Shibata et al; Published: Mar. 18, 2003; Assignee: Ju-Oh Inc., Japan) discloses a metal mold of hot runner type injection molding machine and method of manufacturing the metal mold.

SUMMARY

In a first aspect of the present invention, there is provided a method of a metallic-molding-material runner system for filling a metallic-molding material into a mold cavity of a mold, the metallic-molding material includes a metallic component, the method including: substantially equilibrating flow of the metallic-molding material through a collection of branches from a molding system into the mold by; (i) receiving the metallic-molding material from the molding system through an input being defined by a conduit assembly, the conduit assembly including the collection of branches each being configured to pass the metallic-molding material from the input over to outputs of the collection of branches; (ii) conveying the metallic-molding material from the input through the collection of branches of the conduit assembly over to the outputs; (iii) forming plugs in the outputs: and (iv) chronologically blowing out the plugs from the outputs into the mold cavity of the mold.

In a second aspect of the present invention, there is provided a molding system that operates in accordance with the method of the metallic-molding-material runner system described above.

In a third aspect of the present invention, there is provided a method of a metallic-molding-material runner system including substantially equilibrating flow of a metallic-molding material through a collection of branches from a molding system into a mold.

A technical effect of the above aspects is that pack-out problems and/or shrinkage-porosity defects and/or flow defects may be mitigated at least in part.

BRIEF DESCRIPTION OF THE FIGURES

A better understanding of the exemplary embodiments of the present invention (including alternatives and/or variations thereof) may be obtained with reference to the detailed description of the exemplary embodiments along with the following drawings, in which.

The drawings are not necessarily to scale and are sometimes illustrated by phantom lines, diagrammatic representations and fragmentary views. In certain instances, details that are not necessary for an understanding of the embodiments or that render other details difficult to perceive may have been omitted.

DETAILED DESCRIPTION OF THE EXEMPLARY EMBODIMENTS

Figure 1:
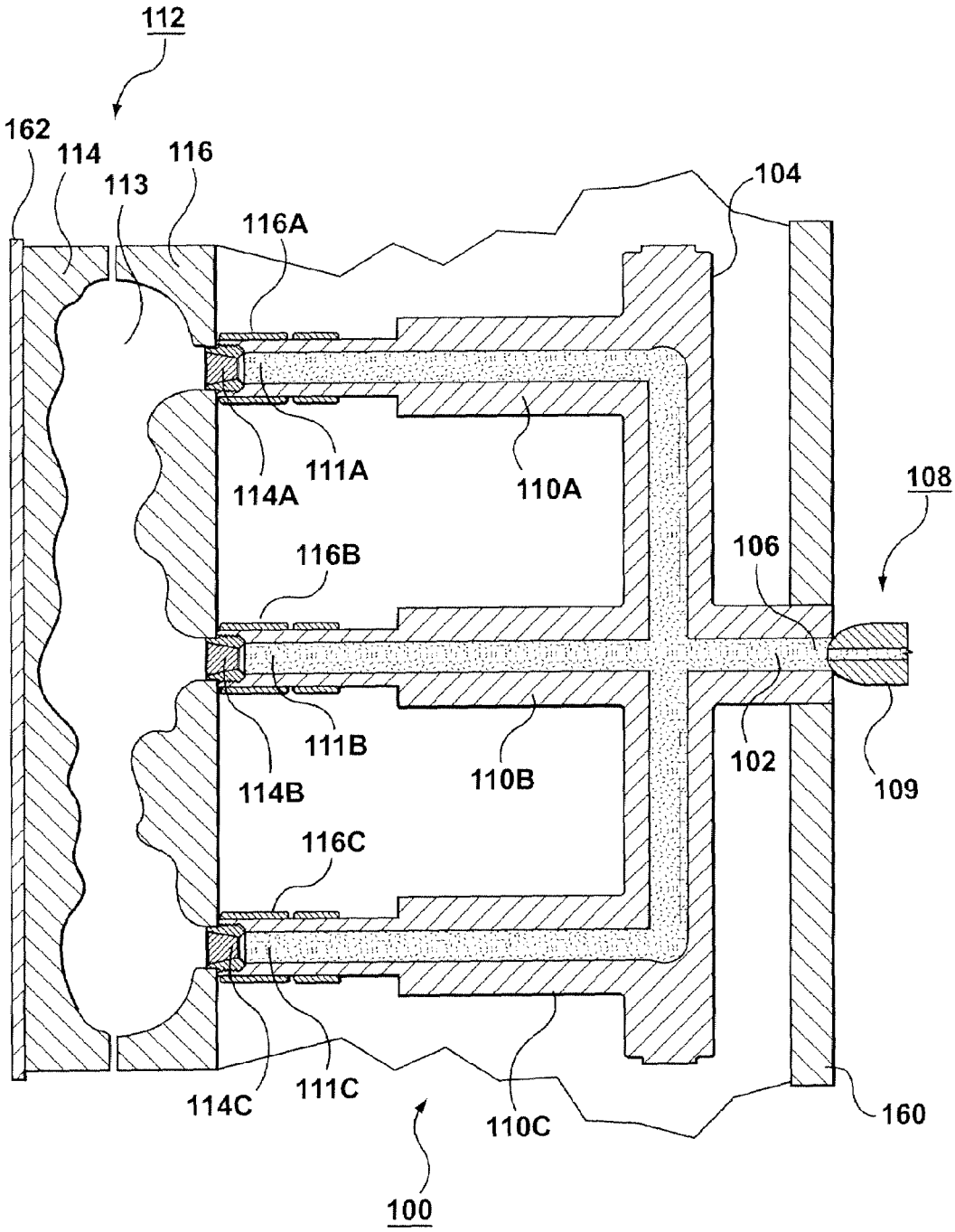
FIG. 1 is a cross-sectional view a metallic-molding-material runner system according to a first embodiment.

FIG. 1 is a cross-sectional view a metallic-molding-material runner system 100 (hereafter referred to as the "runner" 100) according to the first exemplary embodiment, which is the preferred embodiment or the best mode. The runner 100 is depicted as primed and ready to fill a metallic-molding material 102 (hereafter referred to as the "material" 102) into a mold cavity 113 of a mold 112. Preferably, the material 102 includes a metallic component and does not substantially include a resin-based, plastic component.

Advantageously, the runner 100 is arranged so that collection of branches 110A, 110B, 110C is configured to equilibrated flow of the metallic-molding material 102 adjustably in situ, and the technical effect is that the runner 100 may be adjusted on the fly to suit situational conditions as parts are molded, and the runner 100 may be adapted or modified or adjusted (with less effort) for use with differently-shaped molds.

Briefly, the runner 100 includes a collection of branches 110A, 110B, 110C that is configured to substantially equilibrated flow of the material 102 from a molding system 108 into a mold 112. Preferably, the collection of branches 110A, 110B, 110C is configured to equilibrated flow of the material 102 so that the mold 112 may become substantially evenly filled with the material 102 (in a substantially balanced manner) prior to an application of a pack-out pressure onto to the material 102 received in the mold 112, so that once the pack-out pressure is applied the material 102 held in the mold 112 may be substantially packed-out in a substantially balanced way so as to reduce shrinkage-porosity defects and/or flow defects at least in part. A technical effect of the runner 100 is that pack-out problems and/or shrinkage-porosity defects and/or flow defects may be mitigated at least in part.

Preferably, the collection of branches 110A, 110B, 110C is configured to chronologically convey and/or release the material 102 from the molding system 108 into the mold 112. The runner 100 includes a conduit assembly 104. The conduit assembly 104 defines an input 106 that is configured to receive the material 102 from the molding system 108 (preferably from a machine nozzle 109 of the molding system 108). The conduit assembly 104 also includes the collection of branches 110A, 110B, 110C that are each configured to pass the material 102 from the input 106 over to outputs 111A, 111B, 111C respectively. The outputs 111A, 111B, 111C are configured to chronologically convey the material 102 from the branches 110A, 110B, 110C into the mold 112 (preferably via mold gates or entrances of the mold 112). Preferably, the outputs 111A, 111B, 111C chronologically convey the material 102 according to a chronological-release sequence.

Many combinations and permutations of actuating the outputs 111A, 111B, 111C according to the chronological-release sequence are contemplated (and many others are possible). According to a first example of a chronological-release sequence, the outputs 111A, 111B, 111C chronologically release the material 102 serially one output after another, such as the following chronological-release sequence that includes the following stages:

Stage 1: initially the output 111A is actuated to release the material 102 into a first section of the mold 112 while the outputs 111B, 111C withhold release of the material 102 into the mold 112;

Stage 2: after a time delay, the output 111B is actuated to release the material 102 into a second section of the mold 112 (while the output 111A continues unobstructed release of the material 102 into the mold 112), and the output 111C continues withholding release of the material 102 into the mold 112; and Stage 3: after another time delay, the output 112C is actuated to release the material 102 into a third section of the mold 112 while the outputs 111A, 111B continue unobstructed release of the material 102 into the mold 112. It will be appreciated that flow through the outputs 111A, 111B may (eventually) stop because of the geometry of a specific mold before the flow through the output 111C stops and before the mold cavity 113 becoming entirely filled. For example, the first section of the mold 112 has a thickness that is larger than the thickness of the second section of the mold 112, and the second section of the mold 112 has a thickness that is larger than the thickness of the third section of the mold 112.

According to a second example, the following chronological-release sequence includes the following stages:

Stage 1: the output 111C releases the material 102 into the mold 112; and Stage 2: after a time delay, both outputs 111A, 111B release the material 102 at the same time into the mold 112 while output 111C continues unobstructed release of the material 102 into the mold 112.

A chronological-release is an arrangement in order of time of occurrence. It would be within the scope of the meaning of "chronological-release" to include sequentially releasing of one thing after another (as in a succession).

According to a variant, the conduit assembly 104 includes two outputs. According to another variant, the conduit assembly 104 includes more than three outputs.

Preferably the outputs 111A, 111B, 111C are configured to form plugs 114A, 114B, 114C respectively in the outputs 111A, 111B, 111C. Preferably, the outputs 111A, 111B, 111C cooperate with respective plug-managing mechanisms 116A, 116B, 116C respectively. The plugs 114A, 114B, 114C may be formable in their respective outputs 111A, 111B, 111C by using plug-managing mechanisms 116A, 116B, 116C respectively. Operation of the plug-managing mechanisms 116A, 116B, 116C is well known in the molding art and therefore this operation will not be described in detail here. The plugs 114A, 114B, 114C are configured to chronologically release from their respective outputs 111A, 111B, 111C so that the material 102 is released chronologically into the mold 112. Preferably, the plugs 114A, 114B, 114C blow out from their respective outputs responsive to a blow-out pressure that is imposed onto the material 102. The blow-out pressure is usually exerted by the molding system 108 as known in the molding art and therefore the process for building up the blow-out pressure is not described here.

For example, the plug-managing mechanism 116C forms the plug 114C (by a cooling process) in the output 111C that is more solid than the plug 114A formed in the output 111A by the pug-managing mechanism 116A. This means that the plug 114A will release before the plug 114C will release. Once the plug 114A is released, a heater positioned at the output 111C is energized to heat up the plug 114C so that the plug 114C becomes susceptible to the pressure in the material 102 enough to blow out from the output 111C.

Alternatively, the plug 114A is a soft plug that is designed to blow out first (under presence of the blow-out pressure) and when the mold cavity 113 surrounding the output 111A becomes filled, resistance is presented back through the material 102 in the branch 110A so that pressure becomes built up (within the conduit assembly 104) sufficiently enough to blow out other plugs (such as the plug 114B and/or the plug 114B).

The mold 112 includes a mold half 114 and a mold half 116. The mold half 116 is connected to the runner 100, and the runner 100 is connected to a stationary platen 160. The mold half 114 is connected to a movable platen 162. A platen-stroking actuator (not depicted) is used to move the movable platen 162 relative to the stationary platen 160 between a mold-opened position and a mold-closed position so that the mold halves 114, 116 may be opened and closed against each other. A clamping mechanism (not depicted) is used to apply a clamping force and a mold-break force to the mold 112. Since the platen-stroking actuator and the clamping mechanism are well known in the art of molding systems, therefore they will not be described here in detail.

Preferably, the runner 100 does not include the molding system 108 and/or the mold 112. Preferably, the material 102 includes a metallic component and does not include a plastic-resin component. Preferably, the material 102 is a metallic-molding material such as an alloy of magnesium, etc. According to a variant of the first embodiment, the runner 100 is integrated into the molding system 108.

According to another variant of the first exemplary embodiment, the outputs 111A, 111B, 111C each include respective nozzles (not depicted) that are configured to chronologically release the material 102 into the mold 112. The nozzles are mechanical shut off mechanisms, and plugs 114A, 114B, 114C are not used. According to a variation, a mix and match of plugs and nozzles are used with the outputs 111A, 111B, 111C.

Figure 2A:
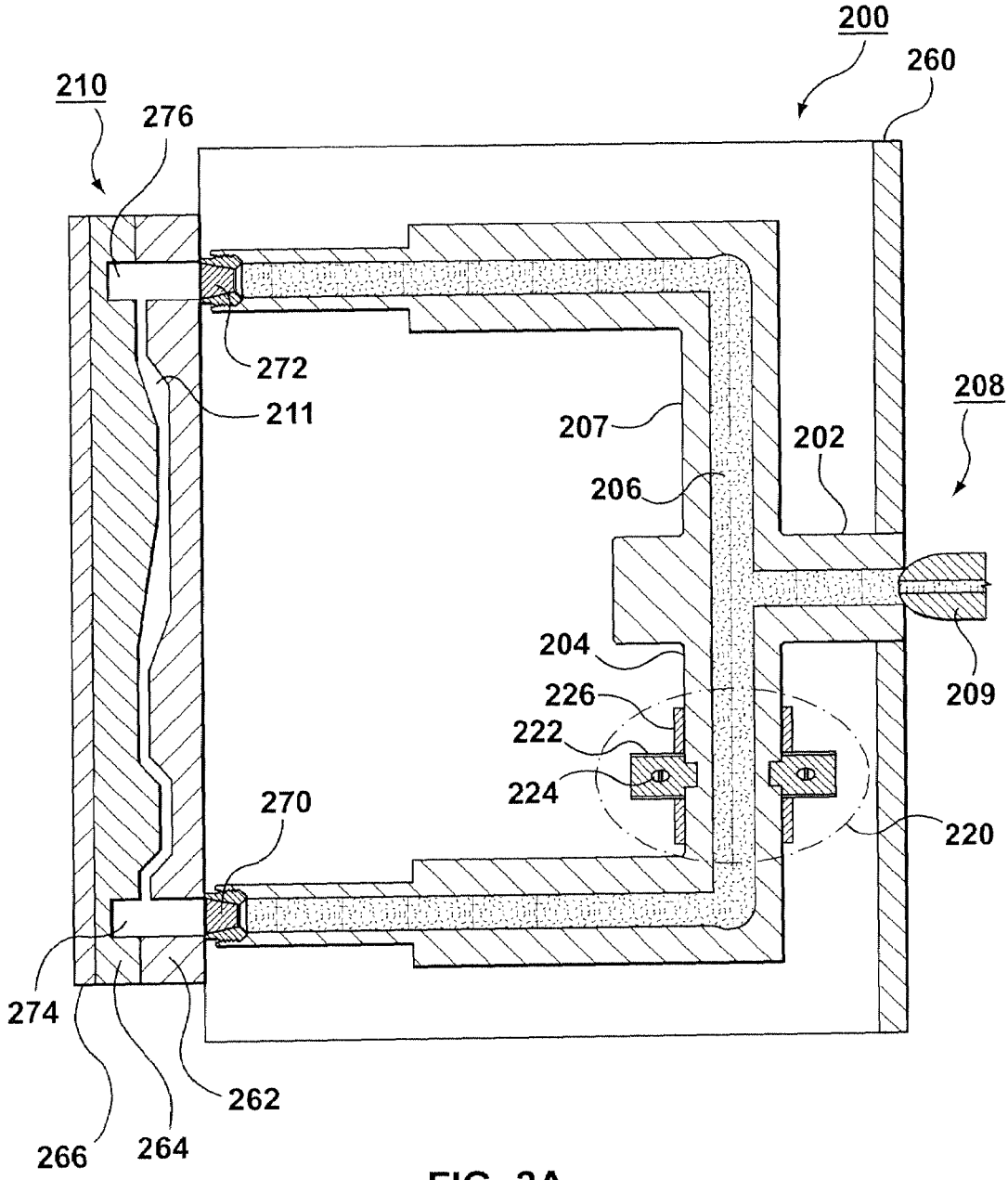
FIGS. 2A, 2B are a cross-sectional views of a metallic-molding-material runner system according to a second exemplary embodiment.
Figure 2B:
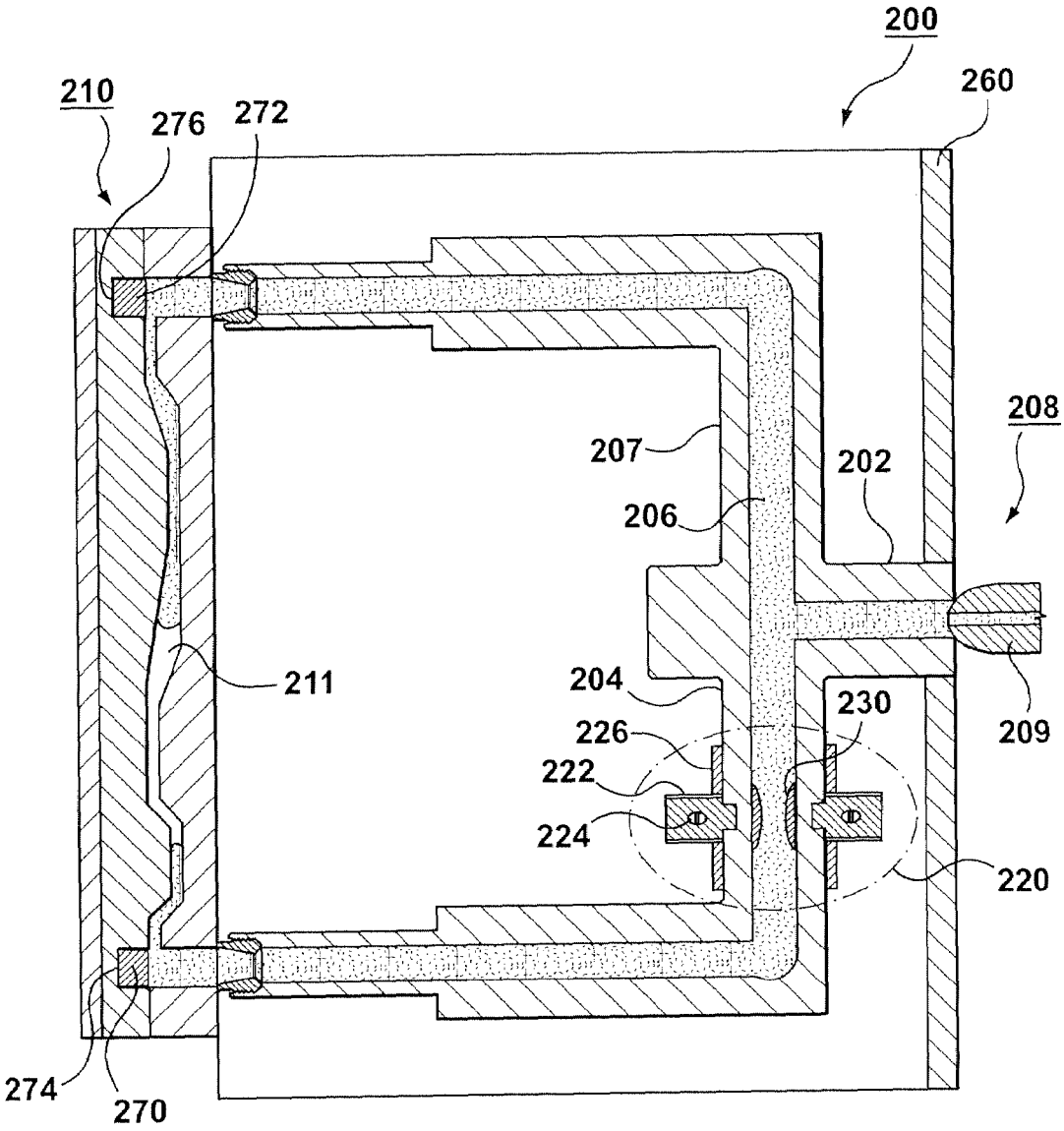

FIGS. 2A, 2B are a cross-sectional views of a metallic-molding-material runner system 200 (hereafter referred to as the runner" 200) according to the second exemplary embodiment. The runner 200 is depicted as primed and ready to distribute a molding material 206 (hereafter referred to as the "material" 206) into a mold cavity 211 of a mold 210.

Briefly, the runner 200 includes a collection of branches 204, 207 that is configured to substantially equilibrated flow of the molding material 206 from a molding system 208 into a mold 210. Preferably, the collection of branches 204, 207 is configured to equilibrated flow of the molding material 206 so that the mold 210 may become substantially evenly filled with the molding material 206 (in a substantiality balanced manner) prior to an application of a pack-out pressure onto the molding material 206 received in the mold 210, so that once the pack-out pressure is applied the molding material 206 held in the mold 210 may be substantially packed-out in a substantially balanced way so as to reduce shrinkage-porosity defects and/or flow defects at least in part. A technical effect of the runner 200 is that pack-out problems and/or shrinkage-porosity defects and/or flow defects may be mitigated at least in part.

Advantageously, the runner 200 is arranged so that collection of branches 204, 207 is configured to equilibrated flow of the molding material 206 adjustably in situ, and the technical effect is that the runner 200 may be adjusted on the fly to suit situational conditions as parts are molded, and the runner 200 may be adapted or modified or adjusted (with less effort) for use with differently-shaped molds.

Preferably, the collection of branches 204, 207 is configured to adapt flow rate of the molding material 206 from the molding system 208 into the mold 210. The runner 200 includes a conduit assembly 202 that has branches 204, 207 both of which lead into the mold cavity 211. The branches 204, 207 pass the molding material 206 from the molding system 208 over to the mold 210. Preferably, the runner 200 does not include the molding system 208 and/or the mold 210. According to a variation, the runner 200 includes the molding system 208. The molding system 208 prepares the molding material 206 that is to be then placed into the runner 200.

Preferably, the runner 200 also includes a flow reducer 220 that is coupled to the branch 204. A flow reducer has not been placed in the branch 207 so that flow of the molding material 206 through the branch 207 is not reduced or inhibited; however, if desired, a flow reducer may be placed in the branch 207. The flow reducer 220 is configured to selectively reduce flow of the molding material 206 through the branch 204 and into the mold 210 prior to the mold 210 becoming filled with the molding material 206. The molding system 208 is connected to the conduit assembly 202 via a nozzle 209, which is partially depicted. The rate of flow in the branch 204 may be adjusted to suit the requirements of a specific mold. According to a variant of the second exemplary embodiment, the runner 200 is integrated or part of the molding system 208.

The mold 210 includes a mold half 262 and a mold half 264. The mold half 262 is connected to the runner 200. The runner 200 is connected to a stationary platen 260. The mold half 264 is connected to a movable platen 266. Platen-stroking actuators (not depicted) are used to move the movable platen 266 relative to the stationary platen 260 between a mold-opened position and a mold-closed position so that the mold halves 262, 264 may be opened and closed against each other. A clamping mechanism (not depicted) is used to apply a clamping force and a mold-break force to the mold 210. Since operation of the platen-stroking actuators and the clamping mechanism are well known in the art, they will not be described in detail.

Preferably, the molding material 206 includes a metallic component, and more preferably, the molding material 206 includes an alloy of magnesium, etc. Preferably, solidified plugs of magnesium alloy 270, 272 (hereafter referred to as the "plugs 270, 272" are formed (that is, formed from the molding material that is located in branches 204, 207 respectively at exit positions of the runner 200; the exits lead into the mold cavity 211 of the mold 210). Since the process of formation of the plugs 270, 272 is known in the art, therefore the formation process will not be described here. The exit positions are located at entrances (gates) That lead into the mold cavity 211. The mold 210 defines plug catchers 274, 276 for catching the plugs 270, 272 respectively once the plugs are ejected from the depicted positions in FIG. 2A upon filling the mold 210 with the molding material 206.

Preferably, the flow reducer 220 includes a heat-energy remover 222 that is configured to couple to the branch 204 and to remove an amount of heat energy from the branch 204. In response to the removal of the amount of heat energy from the branch 204, the molding material 206 (that is, the molding material located in the branch 204 and located proximate to the heat-energy remover 222) solidifies to form a patch of solidified molding material 230 (hereafter referred to as the "patch 230", not depicted in FIG. 2A, but is depicted in FIG. 2B). The patch of solidified molding material 230 is hereafter referred to as the "patch" 230. The patch 230 attaches to the branch 204 and reduces flow of the molding material 206 through the branch 204 and into the mold 210 prior to the mold 210 becoming filled with the molding material 206. Preferably, the patch 230 is formed to partially block the flow of the molding material 206 through the branch 204. According to a variant the patch 230 may be formed to reduce the flow to a zero-flow condition (that is, no flow) of the molding material 206 (before the mold 210 is filled) if this condition is required in the process of filling the mold 210.

Preferably, the flow reducer 220 also includes a cooling body 224. The cooling body 224 is configured to pass a coolant proximate to the branch 204. The coolant is used to remove an amount of heat energy from the portion of the branch 204 that is coupled to the flow reducer 220. In response to the removal of the heat energy, the molding material 206 (that is located in the branch 204 and that is located proximate to the heat-energy remover 222) solidifies to form the patch 230.

Preferably, the flow reducer 220 includes a heater 226. The heater 226 is positioned proximate to the flow reducer 220 (that is, positioned either within the flow reducer 220 or outside of the flaw reducer 220). The heater 226 is used to counter balance the heat sinking effect introduced by the cooling body 224 so as to prevent the patch 230 from getting too large.

FIG. 2B is a cross-sectional view of the runner 200 in which the runner 200 is depicted distributing the molding material 206 into the mold 210. The molding system 208 has pressurized the molding material 206 in the manner as known in the art (and so this process will not be described here). As a result of pressurization, the molding material 206 is subjected to a plug blow-out pressure of sufficient strength that the plugs 270, 272 are depicted blown out from their formed positions in their respective branches 204, 207 and displaced over into the plug catchers 274. 276 respectively. Then, the molding material 206 flows into the mold cavity 211 of the mold 210. The flow reducer 220 is actuated to form the patch 230 elmer before the blow-out of the plugs 270, 272 or after the blow-out of the plugs 270, 272 (but it is preferred to form the patch 230 before the plugs are blown out). The formed patch 230 restricts flow of the molding material 206 through the branch 204 (at the place where the flow reducer 220 is coupled to the branch 204) and into the mold 210. The amount of flow Through branch 207 will be greater than the amount of flow through the branch 204 such that the mold 210 fills more quickly through The mold cavity 211 located proximate to the branch 207 in comparison to the mold cavity 211 that is located proximate to the branch 204.

Once the mold cavity 211 of the mold 210 is filled, new plugs (not depicted) will be formed in the exits of the branches 204, 207 that lead into the mold 210 so that then the mold halves 262, 264 may be separated apart from each other for subsequent removal of an part that was molded in the mold cavity 211. Once the plugs are reformed, the patch 230 may be melted by the heater 226 or may be permitted to persist for subsequent use in the next injection cycle of the molding system 208 as may be required.

According to a variant of the runner 200, a flow reducer is used with each branch 204, 207 so that in response to the removal of heat energy, the molding material 206 (that is located in the branches 204, 207, and located proximate to their flow reducers) solidifies to form respective patches (not depicted) of solidified molding material in each branch 204, 207 respectively. The respective patches attach to their respective branches 204, 207 and reduce flow of the molding material 206 through the respective branches 204, 207 and into the mold 210 prior to the mold 210 becoming filled with the molding material 206. The rate of flow in each branch 204, 207 may be adjusted to suit the requirements of a specific mold. Preferably, the respective patches are sized differently to bias flow of the molding material 206 into the mold 210 (as may be required for a specific mold).

According to a variant of the second exemplary embodiment, the outputs of the branches 204, 207 each include respective nozzles (not depicted) that are configured to release the molding material 206 into the mold 210. The nozzles are mechanical shut off mechanisms, and plugs 270, 272 are not used. According to a variation, a mix and match of plugs and nozzles are used with the outputs of the branches 204, 207.

It will be appreciated that the first exemplary embodiment and the second exemplary embodiment may be used together or separately. For example, according to variation of the first exemplary embodiment, the runner 100 is configured so that the collection of branches (110A, 110B, 110C) is configured to adapt flow rate of the metallic-molding material 102 from the molding system 108 into the mold 112. For example, according to a variation of the second embodiment, the runner 200 is adapted so that the collection of branches 204, 207 is configured to chronologically release the molding material 206 from the molding system 208 into the mold 210.

The description of the exemplary embodiments provides examples of the present invention, and these examples do not limit the scope of the present invention. It is understood that the scope of the present invention is limited by the claims. The concepts described above may be adapted for specific conditions and/or functions, and may be further extended to a variety of other applications that are within the scope of the present invention. Having thus described the exemplary embodiments, it will be apparent that modifications and enhancements are possible without departing from the concepts as described. Therefore, what is to be protected by way of letters patent are limited only by the scope of the following claims:

What is claimed is:

1. A method of a metallic-molding-material runner system for filling a metallic-molding material into a mold cavity of a mold, the metallic-molding material includes a metallic component, the method comprising:

substantially equilibrating flow of the metallic-molding material through a collection of branches from a molding system into the mold by:

receiving the metallic-molding material from the molding system through an input being defined by a conduit assembly, the conduit assembly including the collection of branches each being configured to pass the metallic-molding material from the input over to outputs of the collection of branches;

conveying the metallic-molding material from the input through the collection of branches of the conduit assembly over to the outputs;

forming plugs in the outputs;

chronologically blowing out the plugs from the outputs into the mold cavity of the mold; and removing an amount of heat energy from a branch of the collection of branches at a location away from an output of the branch, and in response the metallic-molding material becomes solidified to form a patch of solidified molding material attaching to the branch, and the patch of solidified molding material reducing flow of the metallic-molding material through the branch and into the mold prior to the mold becoming filled with the metallic-molding material, so that an amount of flow of the metallic-molding material through another branch of the collection of branches will be greater than the amount of flow of the metallic-molding material through the branch.

* * * * *